United States Patent [19]

Saito et al.

[11] Patent Number: 4,629,929

[45] Date of Patent: Dec. 16, 1986

[54] METAL VAPOR DISCHARGE LAMP

[75] Inventors: Masato Saito; Ryo Suzuki, both of Kamakura; Keiji Watanabe, Chigasaki; Michihiro Tsuchihashi, Kamakura, all of Japan

[73] Assignee: Mitsubishi Denki Kabushiki Kaisha, Tokyo, Japan

[21] Appl. No.: 540,430

[22] PCT Filed: Feb. 7, 1983

[86] PCT No.: PCT/JP83/00034

§ 371 Date: Sep. 26, 1983

§ 102(e) Date: Sep. 26, 1983

[87] PCT Pub. No.: WO83/02851

PCT Pub. Date: Aug. 18, 1983

[30] Foreign Application Priority Data

Feb. 10, 1982 [JP] Japan ..... 57-20599
Jan. 19, 1983 [JP] Japan ..... 58-6891

[51] Int. Cl.[4] ..... H01J 61/30
[52] U.S. Cl. ..... 313/25; 313/33
[58] Field of Search ..... 313/25, 47, 33, 26, 313/27

[56] References Cited

U.S. PATENT DOCUMENTS 2,056,628 10/1936 St. Louis ..... 313/33
2,270,276 1/1942 Doering ..... 313/25 X
3,879,625 4/1975 McVey et al. ..... 313/27
4,446,397 5/1984 Johnson et al. ..... 313/25
4,490,649 12/1984 Wang ..... 313/33 X

FOREIGN PATENT DOCUMENTS 41-2865 2/1941 Japan .
41-2867 2/1941 Japan .
24431 9/1970 Japan .
18018 5/1973 Japan .
55-136456 10/1980 Japan .
57-161858 10/1982 Japan .
57-197166 12/1982 Japan .
780474 8/1957 United Kingdom ..... 313/25
2035679 6/1980 United Kingdom ..... 313/25

*Primary Examiner*—Palmer C. DeMeo
*Attorney, Agent, or Firm*—Wenderoth, Lind & Ponack

[57] ABSTRACT

A metal vapor discharge lamp having an outer tube having an inert gas filling the inner space and an arc tube disposed in the interior of this outer tube and having in a discharge space in the interior a pair of electrodes. The discharge space is filled with at least a rare gas and mercury. A lower light transmissive covering member covering at least the lower end part of the arc tube is positioned in the vicinity of the end part of the light emitting tube which is the lower end during lighting. This reduces the temperature reduction of the lower part of the arc tube due to convection of the gas within the outer tube, increasing the temperature of the coldest part of the arc tube, whereby the vapor pressure in the interior of the arc tube is raised to improve luminous efficiency.

11 Claims, 10 Drawing Figures

METAL VAPOR DISCHARGE LAMP

TECHNICAL FIELD

This invention relates to a metal vapor discharge lamp, for example, a metal halide lamp, a high pressure sodium lamp or the like and particularly to an improvement in the luminous efficiency of the arc tube thereof by controlling the temperature thereof.

BACKGROUND ART

FIG. 1 is a front view illustrating the structure of a conventional metal halide lamp of the vertical type. An arc tube (1) made of a quartz glass has a pair of main electrodes (*2a*) and (*2b*) at both ends of the interior thereof and the interior thereof is filled with an inert gas, mercury and a metal halide. An outer tube (3) covers the arc tube (1) and the interior thereof is filled, for example, with a nitrogen gas. A base (4) is disposed at the upper end of the outer tube (3) and electrically connected to the electrodes (*2a*) and (*2b*). A heat-insulating coating (5) is provided at the lower end of the arc tube and formed, for example, of a zirconia coating.

The lamp constructed in this way is normally positioned for use with the base (4) directed upward, but in such a lighted state the lower end of the arc tube (4) is cooled due to a convection of the gas within the arc tube (1) and convection of nitrogen with the outer tube (3) and becomes the coldest part. Since the vapor pressure of the metal halide changes dependent on the temperature of said coldest part, the luminous efficiency also depends upon the temperature of the coldest part. As a means for raising the temperature of said coldest part, there has been used a method of increasing the thickness of the zirconia coating or increasing the width of the coating. However it has been found that, although the use of the heat-insulating coating (5) raises the temperature of said coldest part, the temperature of the coldest part is still low and the luminous efficiency is bad particularly with the outer tube (3) the interior of which is filled with something like the nitrogen gas.

On the other hand, for the purpose of raising the temperature of said coldest part, an increase in thickness of the coating has the disadvantages that it is difficult to maintain the stable characteristic of the coating and the coating peels off in the heat cycles which occur during the lighting and so on. Also an increase in width of the coating increases the proportion of visible light radiating from the electric arc which is absorbed due to the influence of the bonding agent added to zirconia and other coating materials. Alternatively the temperature distribution of the arc tube becomes uneven in the vicinity of the place there where the heat-insulating coating is disposed. Thus there has been the disadvantage that a sufficient improvement in efficiency can not be realized.

As another conventional example of the heat-insulating member, for example, Japanese Patent Publication No. 2867/1966 (U.S. patent application Ser. No. 368,471, May 19, 1964) discloses an arrangement in which a metallic end cap is disposed on one end part of an arc tube and the gap between said end cap and the outer wall of the arc tube is filled with a refractory fibrous material to increase the temperature at the end part of the arc tube. In said arrangement, however, one part of the output of visible light from the electric arc formed within the arc tube during the lighting is absorbed by said refractory fibrous material. Alternatively even though a greater part of the visible light is reflected from said end cap into the electric arc, it is absorbed by a metal halide existing in the electric arc or a disassociated metal. Thus it has not been a desirable heat insulating arrangement from the standpoint of improvement in efficiency.

Further as a conventional example of a separate heat insulating member, for example, Japanese Patent Publication No. 2866/1966 (U.S. patent application Ser. No. 323,672, Nov. 22, 1963) discloses a technique for increasing the temperature of an arc tube by providing a glass tube for enclosing the arc tube along with a shield plate. By said technique, however, the heat insulating effect is certainly improved but the highest temperature of the arc tube is simultaneously raised because the arc tube as a whole is thermally insulated. Thus it is not desirable from the standpoint of the lifetime characteristic of the lamp. Also since the axial temperature difference on the tube wall of the arc tube (the difference between the coldest temperature and the highest temperature) is not improved, the axial unevenness of light emitted from the electric arc remains unimproved. Thus a sufficient improvement in efficiency can not be realized.

DISCLOSURE OF THE INVENTION

The present invention has been made in the light of said prior art disadvantages and an object thereof is to improve the luminous efficiency during the lighting by providing a lower covering member located on lower end part of the arc tube.

Another object of the present invention is to provide a lamp having a high luminous efficiency by disposing a lower covering member in the vicinity of the arc tube and forming an enclosure for the arc tube for enclosing a closed space except for a lead part of an electrode, and a light transmitting structure allowing a radiant output from the electric arc thereby to make it possible to raise the coldest temperature of the arc tube without a loss of the radiant output.

Further another object of the present invention is to make it possible to sharply improve the lamp efficiency by disposing a covering member in the vicinity of the lower end part of the arc tube spaced from the tube wall of the arc tube, the covering member having a shape substantially similar to the sectional shape of the end part of the arc tube whereby the heat insulating effect is enhanced and also the axial temperature of the tube wall of the arc tube is made uniform.

Further, a separate object of the present invention is to make it possible to sharply improve the luminous efficiency by providing a covering member for covering the lower end part of the arc tube, the covering member including an upper end located between a lower sealed bottom surface and an upper sealed bottom surface of the arc tube.

Further, another object of the present invention is to make it possible to sharply improve the luminous efficiency by providing a covering member spaced from the outer wall of the arc tube and covering said arc tube and providing closed structures on the upper and lower sides.

BEST MODE FOR CARRYING OUT THE INVENTION

Figure 2:
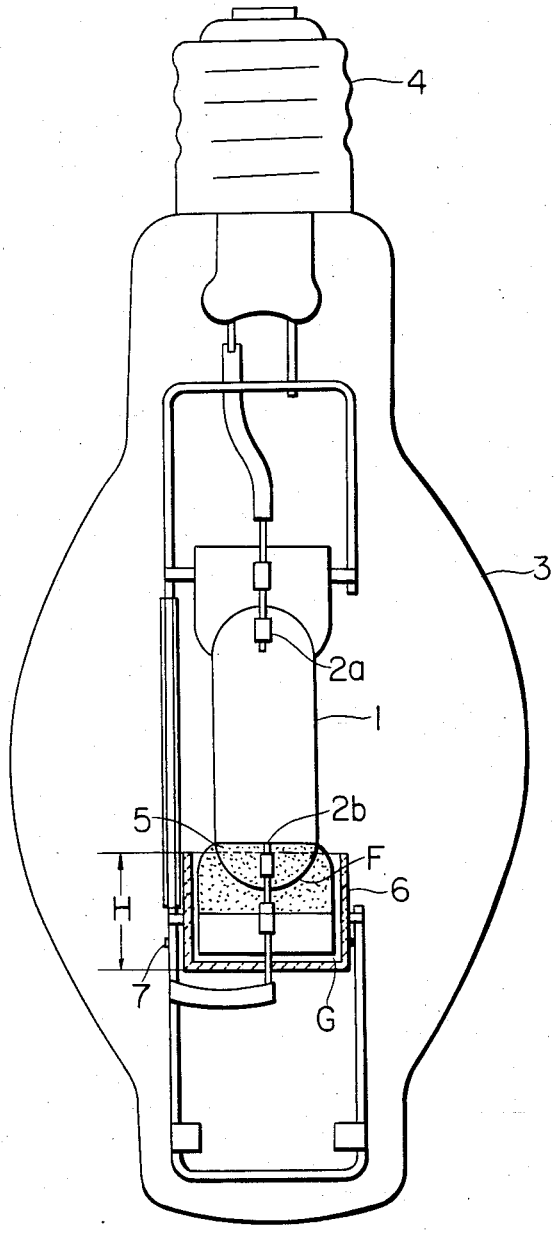
FIG. 2 is a front view illustrating the construction of one embodiment of a lamp according to the present invention.

In FIG. 2, the same reference numerals as in the preceding figure designate the corresponding components. In the Figure (F) and (G) are an inner wall end and a sealed end of an arc tube (1), and (6) designates a lower covering member in the form of a cup having a closed bottom and made of quartz which covers the lower end of the arc tube (1) having a heat-insulating coating (5). Further, (7) designates a band for holding the lower covering member (6).

Figure 1:
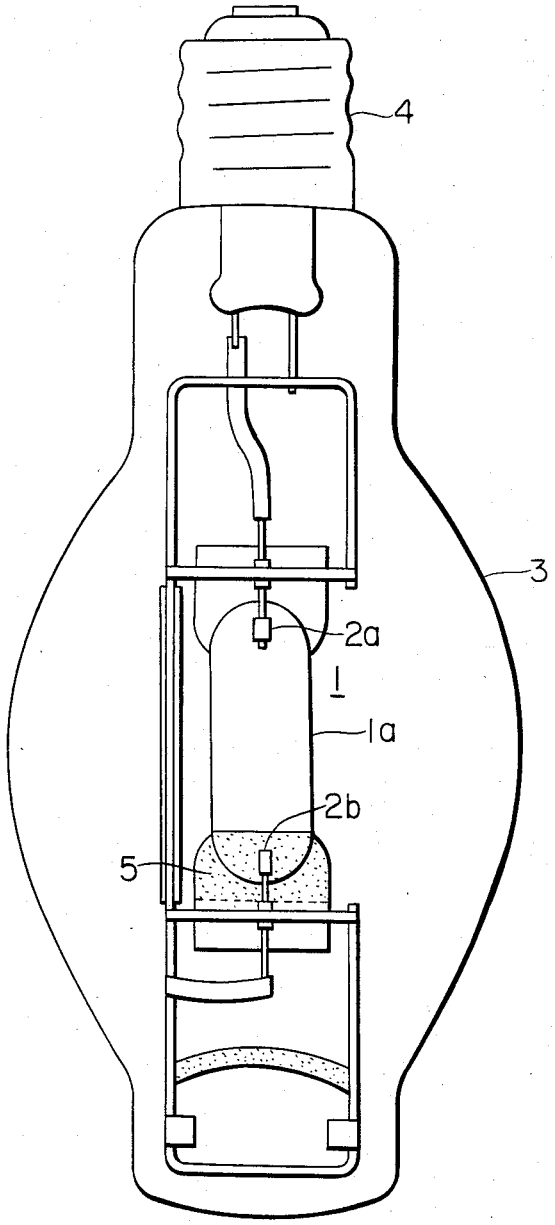
FIG. 1 is a front view illustrating the construction of a conventional lamp.

In order to investigate the effect of such a lower covering member (6), the following experiments have been conducted:

As an example of a conventional lamp, a 400 W metal halide lamp having the construction shown in FIG. 1 was first prepared. The inside diameter of its arc tube (1) was 2 cm, and the distance between electrodes (2*a*) and (2*b*) was 4.5 cm. Filling the arc tube (1) was a proper amount of mercury along with 40 mg of sodium iodide and 7 mg of scandium iodide. Nitrogen gas at a pressure of 560 Torrs was placed in the outer tube (3). This conventional example had a luminous efficiency of 85 lm/W after operation for 100 hours.

The examples of the present invention were identical in construction to the conventional example except for the provision of the lower covering member (6), and the height of the lower covering member (6) was changed as shown in Table 1.

TABLE 1

| H(cm) | Position of Upper End of Lower Covering Member on Light Emitting Tube |
|---|---|
| 1.3 | Intermediate between Inner Wall End (F) and Sealed End (G) |
| 2.5 | Level with Inner Wall End (F) |
| 3.0 | Slightly above Inner Wall End (F) |
| 5.3 | Central Portion of Light Emitting Tube (1) |

The inside diameter of the lower covering member (6) was 3 cm and the thickness was 0.2 cm on both the circumferential surface and the bottom surface. The spacing between the covering member and the bottom of the sealed end (G) was about 0.1 cm.

Figure 3:
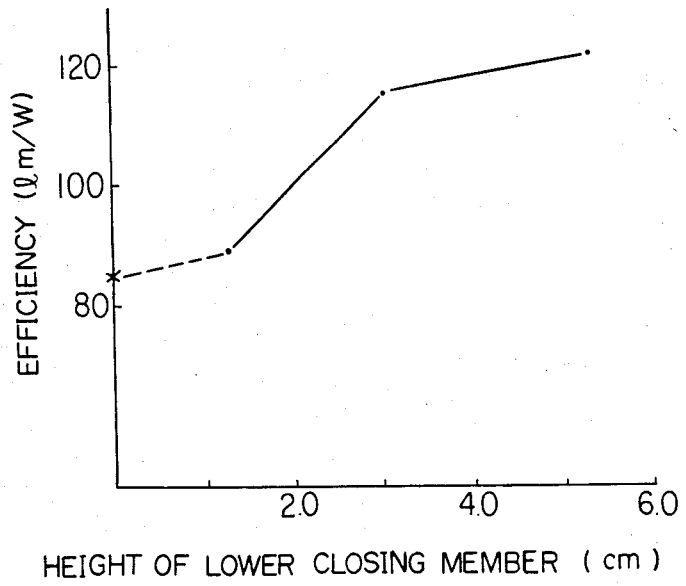
FIG. 3 is a diagram illustrating the comparison of the luminous efficiency of the lamp according to the present invention with that of the conventional lamp.

FIG. 3 shows the luminous efficiency of each of the examples after operation for 100 hours in comparison with the conventional Example (mark X).

As seen in the Figure, it is possible to improve the luminous efficiency by 40% or more and the effect of the lower covering member (6) is apparent. Even when the lower covering member (6) has the upper end located at the upper end of the inner wall end F, there is a particularly noticeable improvement in luminous efficiency.

The foregoing example has been a metal halide lamp filled with scandium iodide and sodium iodide, but a similar effect is obtained with metal vapor discharge lamps, such as high pressure sodium lamps, high pressure mercury lamps etc.

Also while quartz has been used as the lower covering member (6) in said embodiment, materials such as glasses, ceramics, metal oxides, metals etc. may be used as long as they have a suitable heat resistance. A material which has a light transmitting property is generally desirable, but even when material which does not transmit light is used, reductions in luminous efficiency can be prevented by providing a mirror surface on the inner surface, and so on.

Figure 4:
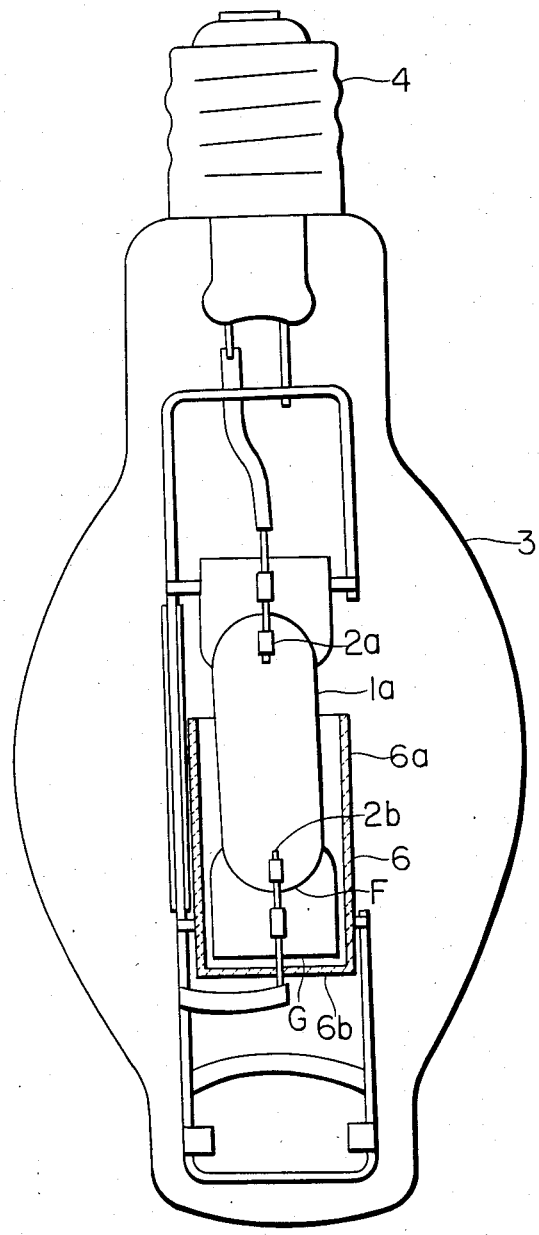
FIG. 4 is a front view illustrating the construction of another embodiment of the lamp according to the present invention.

FIG. 4 is a front view of another embodiment of the present invention, and the same reference numerals as in FIG. 1 designate corresponding components. In the Figure, (6) designates a lower covering member in the form of a cup made of quartz, a heat insulating coating such as coating 5 shown in FIG. 1 is omitted from the end part of the arc tube (1) and the enclosure (1*a*) forming the closed space part for the arc tube (1) is a light transmitting material able to pass radiant energy except at the positions of the lead parts of the electrodes.

In order to investigate the effect of the present invention as thus constructed, the following experiments have been conducted.

As examples of conventional lamps, 400 W metal halide lamps having the structure shown in FIG. 1 were first prepared. The inside diameter of each arc tube (1) was 2 cm, and the distance between electrodes (2*a*) and (2*b*) was 4.5 cm. Filling the arc tube was a proper amount of mercury and argon gas under a pressure of 20 Torrs along with 9.5 mg of sodium iodide and 10.6 mg of scandium iodide. Nitrogen gas filled the outer tube (3). The luminous efficiency was investigated by changing the height of a zirconia coating corresponding to coating 5 which was 60$\mu$ thick. The highest luminous efficiency of 111 lm/W was obtained with a coating height up to 0.2 cm above the upper end of the electrode (2*b*).

The example of the embodiment of the present invention was identical in construction to the conventional examples excepting that the heat insulating zirconia coating was omitted and a lower covering member (6) was provided. The lower covering member (6) had an inside diameter of 3 cm and a thickness of 0.3 cm on both the circumferential surface (6*a*) and the bottom surface (6*b*). The spacing between the bottom surface (6*b*) and the sealed end (G) of the arc tube was 0.5 cm and the height of the upper edge of the covering member (6) was three quarters of the distance between the electrodes (2*a*) and (2*b*). The luminous efficiency was found to be 123 lm/W.

Figure 5:
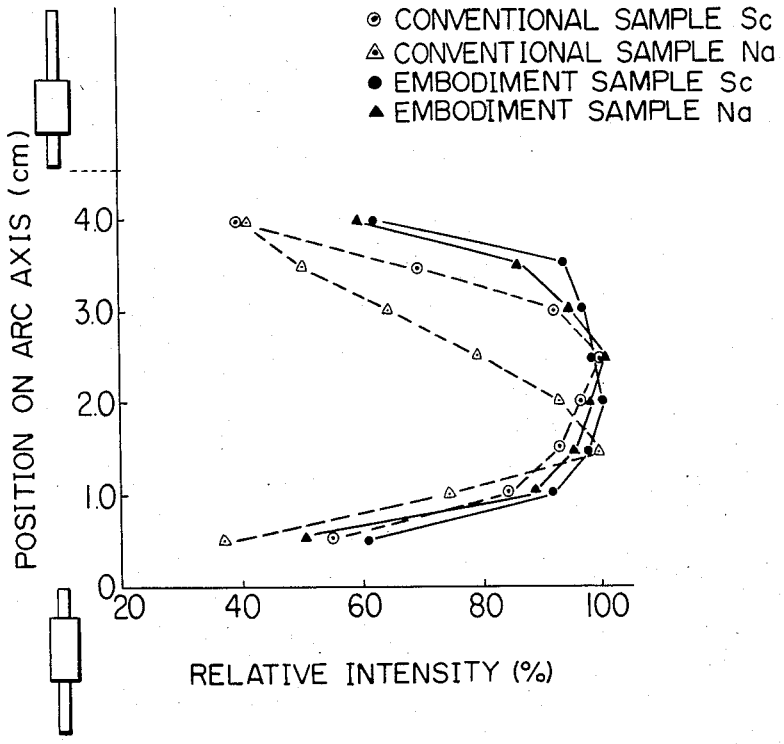
FIG. 5 is a distribution diagram illustrating brightness distributions of scandium and sodium in the lamps shown in FIGS. 1 and 4.

The brightness distributions of scandium and sodium were measured in the axial direction of the electric arc in both the conventional example and the example of the embodiment. FIG. 5 shows the results of those measurements. As is apparent from the Figure, in the case of the embodiment of the present invention as compared with the conventional example, light emitted at points along the axis of the electric arc from scandium and sodium is less uneven and more uniform emission of light is obtained (which is remarkable particularly in the case of sodium). It is considered that this is because the lower covering member is provided and therefore the lower end can be prevented from excessively cooling due to convection within the outer tube, so that the coldest temperature in the vicinity of the main electrode (2*b*) is raised, and because the upper portion of said covering member is open, the tube wall of the arc tube in the vicinity of the open part is somewhat cooled resulting in the temperature of the tube wall of the arc tube being made more uniform.

Further examples of conventional 100 W metal halide lamps having the structure shown in FIG. 1 were prepared. The inside diameter of the arc tube (1) was 1 cm and the distance between electrodes (2*a*) and (2*b*) was 1.8 cm. The arc tube was filled with a proper amount of mercury and an argon gas under a pressure of 20 Torrs along with 12 mg of sodium iodide and 3.4 mg of scandium iodide. The luminous efficiency was investigated by changing the height of zirconia coating corresponding to coating 5 which was 60μ thick. The highest luminous efficiency of 65 lm/W was obtained with a coating height 3.5 mm above the upper end of the electrode (2*b*).

An example of the present invention was prepared which was identical in construction to the conventional example excepting that the heat insulating zirconia coating was omitted and a lower covering member (6) was provided. The lower covering member (6) had an inside diameter of 1.8 cm, and a thickness of 0.25 cm on both the circumferential surface and the bottom surface. The spacing between the bottom surface and the sealed end (G) was 0.3 cm and the height of the upper edge of the covering member (6) was at the position of the arc side-end of the electrode (2*a*). The luminous efficiency was 73 lm/W.

It is considered that the main reason for the sharply improved luminous efficiency as described above and achieved by providing the lower covering member (6) is that the arc tube is prevented from being cooled due to the convection of the nitrogen gas filling the outer tube (3), which increases the radiant output of the electric arc greatly as compared with the lamp with the heat insulating zirconia coating, and that the light emitted by the iodides along the axis of the lamp is more uniform, as is apparent from FIG. 3. Moreover, in said embodiment the coldest point of the arc tube is normally on the inner wall in the vicinity to the electrode (2*b*), but in the present embodiment of the invention the coldest points are formed, for example, at two points on the inner wall, one in the vicinity of the electrode (2*b*) and the other in the vicinity of the electrode (2*a*).

While the description has been given of a vertical lamp, a similar effect is achieved by a horizontal lamp and an inclined lamp (i.e. inclined at an angle between the horizontal and the vertical).

The embodiments described thus far have been a metal halide lamp filled with scandium iodide and sodium iodide, but similar effects are obtained with metal vapor discharge lamps such as metal halide lamps having metal halides other than the above-described halides, high pressure sodium lamps, high pressure mercury lamps and the like.

Figure 7:
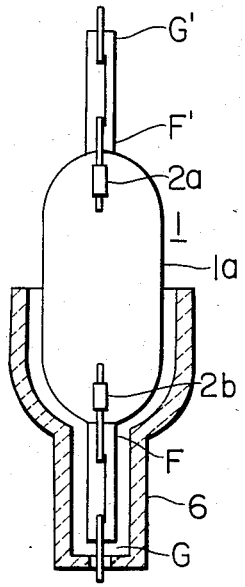
FIG. 7 is a view similar to FIG. 6 illustrating the construction of another embodiment of the present invention.
Figure 9:
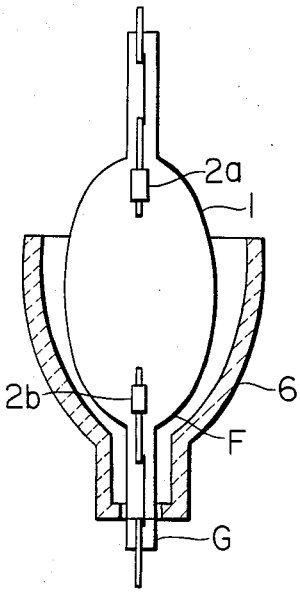
FIG. 9 is a schematic view illustrating a modification of the embodiment of the present invention as shown in FIG. 7.
Figure 10:
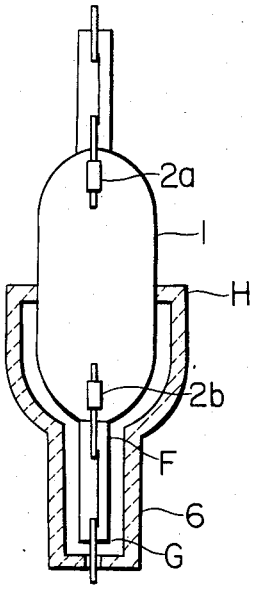
FIG. 10 is a view illustrating the construction of still another embodiment of the lamp of the present invention.

A cup-shaped covering member has been used as the lower covering member, but the invention is not restricted to the cup-like shape, and any appropriate shape can be used. A closed bottom is preferred so that a completely closed bottom structure is provided but, for example, a bottom having a small opening g in one part thereof for accommodating electrode leads, such as shown in FIG. 7 or FIG. 10, or the lower end of the arc tube, as shown in FIG. 9 can be used and the effect of the present invention can still be achieved by making its shape, thickness etc. proper since the opening is sufficiently filled by the leads or the tube to substantially prevent flow of the inert gas therethrough. Therefore the bottom of the covering member should be sufficiently completely closed to substantially prevent flow of the inert gas therethrough.

FIG. 7 is a simplified sectional view showing still another embodiment of the present invention and illustrates only an arc tube (1) and a covering member (6). It is identical in construction to the conventional example shown in FIG. 1 excepting that a heat-insulating zirconia coating is not provided, and instead a covering member according to the invention has been provided. The difference from the embodiment of FIG. 4 is that the covering member (6) is similar in shape to the arc tube (1).

In order to investigate the effect of such an embodiment, the following experiments have been conducted:

As examples of conventional lamps, 400 W metal halide lamps having the structure shown in FIG. 1 were first prepared. The inside diameter of each arc tube (1) was 2 cm and the distance between electrodes (2*a*) and (2*b*) was 4.5 cm. The arc tube was filled with a proper amount of mercury and an argon gas under a pressure of 20 Torrs along with 9.5 mg of sodium iodide and 10.6 mg of scandium iodide. Nitrogen gas filled under a pressure of 560 Torrs filled the outer tube (3). The luminous efficiency was investigated by changing the height of a heat insulating zirconia coating corresponding to the coating 5 which was 60μ thick. The highest luminous efficiency of 111 lm/W was obtained with a coating height up to 0.2 cm above the upper end of the electrode (2*b*) and the lumen output was 52% after 3000 hours of the operation.

Figure 8:
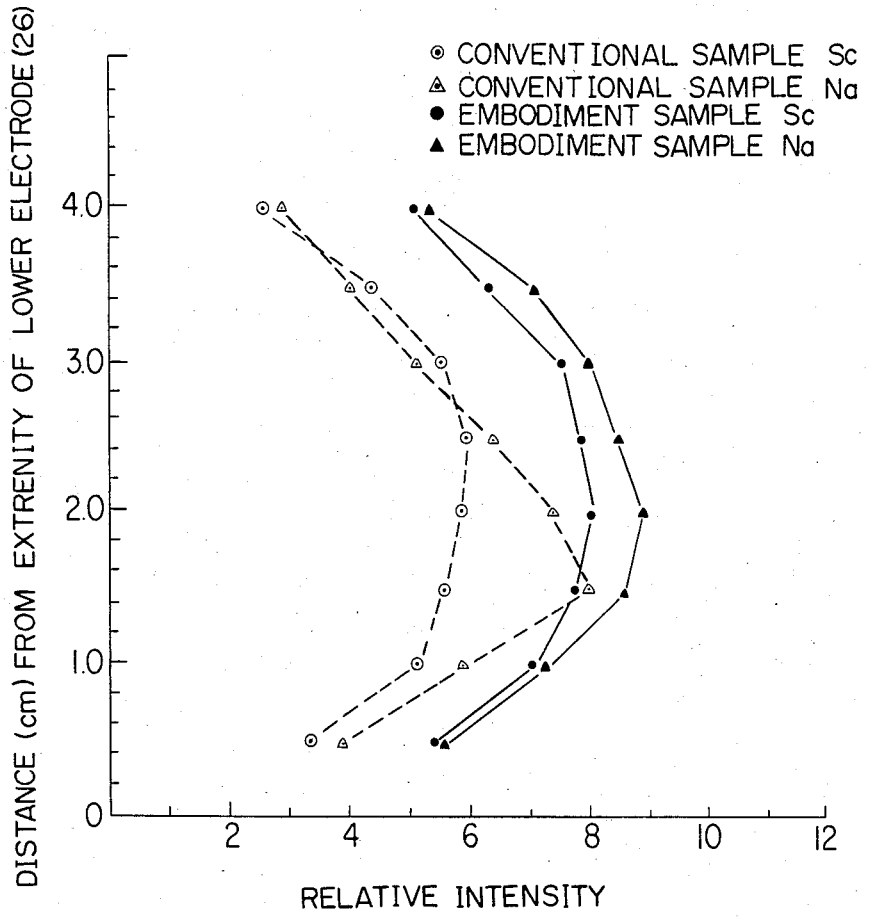
FIG. 8 is a distribution diagram illustrating the brightness distributions of scandium and sodium in the lamps shown in FIGS. 1 and 4.

An example of the present invention was identical in construction to the conventional examples excepting that the heat insulating zirconia coating was omitted and a covering member (6) having a similar shape to that of the arc tube was provided. The covering member (6) had an inside maximum diameter of 2.5 cm and a thickness of 0.05 cm on both the circumferential surface and the bottom surface. The spacing between the bottom surface of the covering member and the sealed end (G) was 0.4 cm and the upper end of the covering member (6) was at a height one half the distance between the electrodes (2*a*) and (2*b*). The luminous efficiency was 129 lm/W and the lumen output was 73% after 3000 hours of the operation. The brightness distributions of scandium and sodium along the axis of the electric arc were measured both for the conventional examples and the embodiment of the present invention. FIG. 8 shows the results of those measurements. As is apparent from the Figure, in the conventional example the axial brightness distributions and particularly the brightness distribution for sodium tend to be greater toward the lower end during the lighting. On the other hand, it is seen with the embodiment of the present invention, the brightness distributions of scandium and sodium tend to be comparatively uniform on the whole.

Thus in the lamp according to the present invention, a covering member is provided which has a sectional profile substantially similar to that of the lower end part of the arc tube, thereby preventing the arc tube from cooling excessively due to convection in the outer tube, because the covering member reflects infrared rays emitted from the arc tube or because the temperature of the covering member is raised by the energy from the arc tube through heat conduction whereby the temperature of the coldest part of the arc tube is raised. Furthermore, as compared with the use of the conventional heat insulating coating, the temperature distribution along the tube wall in the vicinity of the heat insulating coating (the end part of the arc tube) is made more even so that the differences in temperature along the axis of the tube is reduced, whereby the unevenness of light emitted by Sc and Na along the axis of the tube is reduced and a high luminous efficiency and maintenance of excellent lumen output can be achieved.

Further examples of conventional 100 W metal halide lamps having the structure shown in FIG. 1 were prepared. However the arc tube had a structure the same as the embodiment shown in FIG. 9. That is to say, the arc tube (1) had an elliptic shape with an inside maximum diameter of 1.2 cm and a distance of 1.8 cm between the electrodes (2*a*) and (2*b*). The arc tube (1) was filled with a proper amount of mercury and an argon gas under a pressure of 20 Torrs along with 9 mg of sodium iodide and 2.5 mg of scandium iodide. The luminous efficiency was investigated by changing the height of a zirconia coating corresponding to coating 5 which was 60μ thick. The maximum luminous efficiency of 69 lm/W and a lumen output of 41% after 3000 hours of the operation was obtained with a coating height with the upper edge 0.3 cm above the upper end of the electrode (2*b*).

An example of an embodiment of the present invention identical in construction to the conventional example was prepared, excepting that a heat insulating zirconia coating was omitted and a covering member (6) was provided as shown in FIG. 9. The covering member (6) had an inside maximum diameter of 1.8 cm and a thickness of 0.1 cm on the circumferential surface and the bottom surface. The lower end of the covering member (6) was located 0.2 cm above the sealed end (G) and one part of the bottom surface had an opening therein. The upper end of the covering member (6) was at a position nine tenths of the distance between the electrodes (2*a*) and (2*b*). The luminous efficiency was 84 lm/W and a lumen output of 67% after 3000 hours of the operation was obtained.

Thus in the metal vapor discharge lamp according to the present invention, the temperature of the coldest part is raised, the density distribution of emitted light of the halides in the lamp are made more uniform, a high efficiency is achieved and the maintenance of lumen output is also excellent.

In said embodiment, it is preferred to omit the heat insulating coating on the end part of the arc tube to achieve the high luminous efficiency and improve lumen output maintenance, but even if the heat insulating coating is provided, it is possible to achieve some improvement in luminous efficiency. It is preferable that the covering member have a sectional profile substantially similar to that of the end part of the arc tube and that the lower end of the covering member be closed, but even if an opening is provided in the lower end, the effect of the present invention can be achieved by properly selecting the distance between the wall of the arc tube (1) and the covering member (6) and the position of the lower end of the covering member (6).

Figure 6:
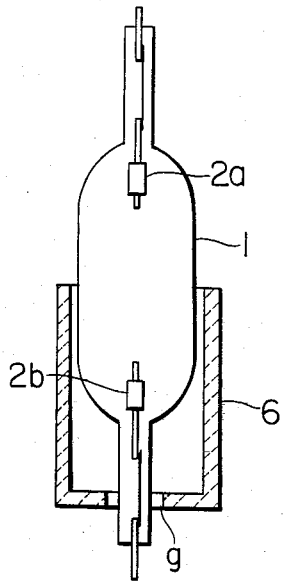
FIG. 6 is a schematic view illustrating a modification of the lamp of the present invention as shown in FIG. 4.

For example, the structure such as shown in FIG. 6 may be modified so that the lower end of the covering member (6) is welded and fixed at any position between the sealed bottom surface (F) and the sealed end (G). Also the structure of the upper end of the covering member (6) is not restricted only to an open structure such as in the embodiments of FIGS. 2, 4, 6, 7 and 9.

It is also possible to coat on one portion of the inner or outer surface of the covering member (6) a heat insulating coating of zirconia, platinum or the like or a light transmissive, infrared reflecting film of silver oxide-titanium oxide or the like. In order to investigate the effect of this aspect of the present invention, the following experiments have been conducted:

An embodiment of the present invention identical in construction to the conventional example used in comparison with the embodiment of FIG. 7 was prepared, excepting that a heat insulating zirconia coating was omitted and a lower covering member (6) was provided. Lower covering members (6) were provided which had an inside maximum diameter of 2.5 cm and a thickness of 0.05 cm on both the circumferential surface and the bottom surface. The spacing between the outer wall surface of the arc tube and the inner wall surface of the lower closing member was 1 mm. The spacing between the bottom surface and the sealed end (G) was 0.4 cm. The covering members were different heights.

TABLE 2

| | Height* of Upper End of Lower Covering Member (cm) | Luminous Efficiency | Radiant Power of SC 567 (Relative Value) | Radiant Power of Na 819 (Relative value) |
|---|---|---|---|---|
| Conventional | — | 111 | 100 | 100 |
| | 2.0 | 115 | 110 | 95 |
| | 3.3 | 130 | 116 | 108 |
| Embodiment | 4.3 | 127 | 115 | 112 |
| | 5.5 | 124 | 112 | 117 |
| | 6.5 | 120 | 105 | 119 |
| | 7.5 | 110 | 97 | 111 |

*Indicated by the distance from the base surface (F) of the sealed part.

Along with a luminous efficiency, the power of scandium (Sc) at 567 nm and sodium (na) at 819 nm were measured. The results thereof are shown in Table 2. The height of the upper end of the lower covering member (6) was the distance from the bottom surface (F) of the lower sealed part. The distances from the bottom surfaces (F) and (F') of the sealed part to extremities of the electrodes (2*a*) and (2*b*) were 1 cm.

As is apparent from the Table, the highest luminous efficiency was obtained when the upper end of the lower covering member (6) was at a height 3.3 cm (a position corresponding to substantially one half the distance between the electrodes).

As also understood from the results of the measurements thereof, the power of the radiation of Sc and Na increased to reach the heighest luminous efficiency with an increase in height of the lower covering member (6) of 3.3 cm. Thereafter, as the height of the lower covering member (6) increased, the power of the radiation Sc slightly decreased, but the power of the radiation of Na continued the tendency to increase until the height of the lower covering member (6) reached 6.5 cm (the position of the upper sealed bottom surface (F). Thus if the height of the upper end of the lower covering member (6) is in a range of from the lower sealed bottom surface (F) to the upper sealed bottom surface (F') then the heat insulating effect and the making the temperature of the tube wall of the arc tube more uniform can be achieved. Accordingly there is provided more uniform vapor densities of Sc and Na along the axis of the electric arc than in the examples of the conventional lamps and the luminous efficiency was improved.

Subsequently the spacing between the outer wall surface of the end part of the arc tube and the inner wall surface of the lower covering member was varied, and the luminous efficiency was investigated. Investigation of the effects of changing the composition of the scandium iodide and sodium iodide filling the arc tube, the thickness and height of the lower covering member etc., was also carried out, and it was found that, by making said spacing not less than 0.05 cm, a lamp having an excellent luminous efficiency as compared with the prior art structure was obtained. The improvement of the luminous efficiency is particularly great when said spacing ranges from 0.2 to 1.0 cm. This is considered to be attributable to the fact that with a spacing of less than 0.05 cm, the distance between the end part of the arc tube and the lower covering member is too short to provide a sufficient heat insulation effect because the end part of the arc tube is cooled principally by means of the heat conduction through the nitrogen gas filling the outer tube. Further, when the covering member with the closed bottom and the end of the light emitting tube are partly contacted without the above interval, a large amount of energy can be directly transmitted by means of thermal conduction as compared with the case in which the above interval is provided, since the temperature insulating effect becomes extremely small.

In order to investigate the preferred thickness of the lower covering member (6), conventional 400 W metal halide lamps of the structure shown in FIG. 1 were prepared. The inside diameter and inter-electrode distance of the arc tube were 2 and 4.5 cm respectively. The arc tube was filled with a proper amount of mercury and an argon gas along with 31 mg of sodium iodide and 8.7 mg of scandium iodide. The outer tube 3 was filled with nitrogen gas under a pressure 560 Torrs, and heat insulating coatings like coating 5 having different heights and 60μ thick were placed on tube 1, the highest luminous efficiency of 100 lm/W was obtained with a coating height 0.3 cm above the upper end of the electrode (2*b*).

Examples of the present invention identical in construction to the conventional example were prepared, excepting that the heat insulating zirconia coating was omitted and lower covering members (6) were provided. The lower covering member (6) had an inside maximum diameter of 2.5, the spacing between the outer wall surface of the end part of the arc tube and the inner wall surface of the lower covering member (6) was 0.3 cm and the position of the upper end was 4.3 cm from the sealed bottom surface. The different lower covering members (6) were given various thicknesses and the luminous efficiency was measured. The results thereof are indicated in Table 3.

TABLE 3

| Conventional | Thickness (cm) | Luminous Efficiency (lm/W) |
|---|---|---|
| Conventional Example | — | 100 |
| Embodiment 1 | 0.03 | 98 |
| Embodiment 2 | 0.05 | 105 |
| Embodiment 3 | 0.15 | 120 |
| Embodiment 4 | 0.30 | 123 |
| Embodiment 5 | 0.40 | 115 |
| Embodiment 6 | 0.50 | 110 |
| Embodiment 7 | 0.60 | 103 |

As is apparent from the Table, a higher luminous efficiency than the prior art is obtained with a thickness of not less than 0.05 cm and a considerable improvement in luminous efficiency is obtained particularly with a thickness ranging from 0.15 to 0.40 cm. This is because when the thickness of said lower covering member (6) is small, the cooling effect due to convection within the outer tube is insufficiently prevented and a sufficient heat insulation effect cannot be achieved. Also if the thickness increases, then the influence of the absorption of light emitted by the lower covering member itself cannot be disregarded. Thus a thickness of not more than 0.6 cm is preferable.

Thus the metal vapor discharge lamp according to the present invention raises the temperature of the coldest part of the lamp, makes more uniform the density distributions of light emitted by the metal halides in the tube, and achieves high luminous efficiency.

The structure of the upper end of the covering member (6) is not restricted only to the open structure, but the temperature of the wall of the arc tube adjacent to the upper end part may be controlled by turning the upper end in or reversely expanding it as the occasion demands.

As described above, it is also necessary to space the inner wall of the covering member (6) from the outer wall of the arc tube (1) but in order to hold the covering member (6) and so on, one part of the covering member (6) may contact a part of the arc tube.

FIG. 10 is a sectional view showing still another embodiment of the present invention and illustrates only an arc tube (1) and a covering member (6). It is identical in construction to the conventional lamp shown in FIG. 1 excepting that a heat insulating zirconia coating is omitted and instead a covering member has been provided. The difference from the embodiments described previously is that both the upper and lower ends of the covering member (6) are closed.

In order to investigate the effect of such an embodiment of the present invention, the following experiments were conducted:

Conventional 400 W metal halide lamps having a structure as shown in FIG. 1 were first prepared. The inside diameter of the arc tubes (1) were 2 cm, the distance between electrodes (2*a*) and (2*b*) was 4.5 cm and the distances between the extremities of the electrodes (2*a*) and (2*b*) and the sealed bottom surface (F) were 1 cm. The arc tube (1) were filled with a proper amount of mercury and an argon gas under a pressure of 20 Torrs along with 31 mg of sodium iodide and 8.7 mg of scandium iodide. The outer tube 3 was filled with nitrogen gas under a pressure of 560 Torrs. The luminous efficiency was investigated for different heights of a heat insulating zirconia coating 60μ thick. The highest luminous efficiency of 100 lm/W and a lumen output of 67% after 3000 hours of the operation were obtained for a coating height 0.3 cm above the upper end of the electrode (*2b*).

Embodiments of the present invention identical in construction to the convention examples were prepared excepting that the heat insulating zirconia coating was omitted and covering member (6) were provided as shown in FIG. 10. The covering members (6) each had an inside maximum diameter of 2.5 cm. The spacing between the outer wall of the arc tube and the inner wall of the covering member (6) was 0.1 cm on the upper and lower end parts and 0.25 cm adjacent to the end part G of the arc tube and to the sealed bottom surface F. The covering members were 0.15 cm thick on both the circumferential surface and the base surface and the space between the bottom surface and the sealed end (G) was 0.4 cm.

The covering members were given different heights, and the luminous efficiencies were measured.

TABLE 4

| | Height From Sealed Bottom Surface (F) to Upper End (H) of Covering Member (H) (cm) | Luminous Efficiency (lm/W) | Lumen Output After 3000 Hours of Operation (lm) |
|---|---|---|---|
| Best Conventional Example | — | 100 | 26800 |
| Embodiment 1 | 0 | 83 | 29000 |
| Embodiment 2 | 0.5 | 100 | 34000 |
| Embodiment 3 | 1.0 | 116 | 38050 |
| Embodiment 4 | 2.0 | 123 | 39360 |
| Embodiment 5 | 3.5 | 120 | 36480 |
| Embodiment 6 | 4.5 | 118 | 34000 |
| Embodiment 7 | 5.5 | 105 | 28980 |
| Embodiment 8 | 6.5 | 101 | 26260 |

Table 4 shows the results of measurements of luminous efficiency and lumen output after 3000 hours of operation for the embodiments of the present invention along with the results for the conventional example.

As apparent from the Table, a better luminous efficiency and lumen output characteristics are obtained for the present invention than for the conventional structure when the position of the upper end of the covering member lies in a range of from 1.0 to 4.5 cm from the sealed bottom surface (F).

Thus, in the lamps made according to the present invention, the covering member suppresses the cooling effect due to the convection within the outer tube and has the effect that the temperature of the coldest part of the arc tube is raised by reflection of infrared rays emitted from the light emitting tube by the covering member or the temperature of the covering member is raised by energy propagated from the arc tube through heat conduction. Furthermore, in the embodiments in which the heat insulating coating is omitted, the unevenness of the temperature distribution on the tube wall adjacent to the heat insulating coating (the end part of the arc tube) is improved as compared with when the conventional heat insulating coating is used, and a decrease in the temperature differences axially along the tube wall can be achieved. Thus it is considered that the distribution of the intensities of light emitted by Sc and Na is improved to achieve a high luminous efficiency and an excellent lumen output maintenance.

What is claimed is:

1. A metal vapor discharge lamp comprising: a vertically oriented outer tube having an inert gas filling the interior; a vertically oriented generally tubular arc tube disposed within the interior of said outer tube and having a discharge space in the interior thereof; a pair of electrodes in said discharge space; at least one rare gas filling said discharge space and mercury contained within said discharge space; and a lower visible light transmissive and infrared light reflective covering member having a bottom sufficiently completely closed to substantially prevent flow of the inert gas therethrough and surrounding at least the lower end part of the tube wall of said arc tube and the bottom end of said arc tube and slightly spaced from the tube wall of said arc tube for retaining the inert gas within the outer tube around the lower end part of said arc tube for substantially completely blocking flow of the inert gas past the bottom end and lower part of said arc tube for preventing cooling of the vicinity of the lower end of the arc tube due to convection of the inert gas.

2. A metal vapor discharge lamp as claimed in claim 1 wherein said covering member is formed of a material taken from the group consisting of visible light transmissive glass and visible light transmissive ceramic.

3. A metal vapor discharge lamp as claimed in claim 1 wherein the distance between said covering member and said lower part of said arc tube is at least 0.5 mm.

4. A metal vapor discharge lamp as claimed in claim 1 wherein the upper end of said covering member is open and the space between said covering member and the arc tube communicates with the interior of said outer tube through said open upper end.

5. A metal vapor discharge lamp as claimed in claim 1 wherein said covering member has a shape substantially similar to the external shape of the lower end part of said arc tube.

6. A metal vapor discharge lamp as claimed in claim 1 wherein said electrodes are vertically spaced in said arc tube and the upper end of said covering member is located below the lower end of the upper electrode and above the lower end of said arc tube.

7. A metal vapor discharge lamp as claimed in claim 6 wherein the upper end of said covering member is located substantially midway between said pair of electrodes.

8. A metal vapor discharge lamp as claimed in claim 1 wherein said arc tube has a heat insulating film on the lower end part thereof.

9. A metal vapor discharge lamp as claimed in claim 1 wherein said arc tube is made of a light transmissive material other than at the point at which the leads for said electrodes enter said arc tube.

10. A metal vapor discharge lamp as claimed in claim 1 wherein said covering member is a tube-like member having a closed bottom other than where leads for an electrode extends therethrough.

11. A metal vapor discharge lamp as claimed in claim 1 wherein said covering member has the upper and lower ends closed.

* * * * *